US005411646A

United States Patent [19]

Gossett et al.

[11] Patent Number: 5,411,646

[45] Date of Patent: May 2, 1995

[54] CATHODIC PROTECTION ANODE AND SYSTEMS

[75] Inventors: Robert M. Gossett, Akron; Michael K. Baach, Parma, both of Ohio; Dennis F. Dong, Kingston, Canada; Richard E. Loftfield, Jacksonville, Fla.

[73] Assignee: Corrpro Companies, Inc., Medina, Ohio

[21] Appl. No.: 56,505

[22] Filed: May 3, 1993

[51] Int. Cl.[6] ..... C23F 13/00

[52] U.S. Cl. ..... 204/147; 204/196; 204/280; 204/284; 204/290 F

[58] Field of Search ..... 204/147, 148, 196, 197, 204/280, 283, 284, 290 F; 245/1, 2, 4–9, 11

[56] References Cited

U.S. PATENT DOCUMENTS

| | | | |
|---|---|---|---|
| 225,754 | 3/1880 | Jenkins | 245/8 |
| 1,180,390 | 4/1916 | Gammeter | 245/2 |
| 2,114,517 | 4/1938 | Apel et al. | 245/2 |
| 2,195,632 | 4/1940 | Reum et al. | 245/2 |
| 2,491,225 | 12/1949 | Stearns | 204/196 |
| 2,643,222 | 6/1953 | Cox | 204/196 |
| 2,744,863 | 5/1956 | Andrus | 204/196 |
| 2,876,190 | 3/1959 | Oliver | 204/196 |
| 3,313,721 | 4/1967 | Teel | 204/290 F |
| 3,409,530 | 11/1968 | Locke et al. | 204/196 |
| 3,461,051 | 8/1969 | Vrable | 204/196 |
| 3,632,498 | 1/1972 | Beer | 204/290 F |
| 4,170,532 | 10/1979 | Tatum | 204/196 |
| 4,255,241 | 3/1981 | Kroon et al. | 204/196 |
| 4,292,149 | 9/1981 | Warne | 204/196 |
| 4,502,929 | 3/1985 | Stewart et al. | 204/147 |
| 4,692,066 | 9/1987 | Clear | 204/196 |
| 4,900,410 | 2/1990 | Bennett et al. | 204/196 |
| 5,031,290 | 7/1991 | Brereton et al. | 204/196 |

FOREIGN PATENT DOCUMENTS

| | | | |
|---|---|---|---|
| 896912 | 5/1962 | United Kingdom | 204/147 |

*Primary Examiner*—T. Tung

*Attorney, Agent, or Firm*—Renner, Otto, Boisselle & Sklar

[57] ABSTRACT

A continuous length anode is formed of relatively small valve metal wire having a electrocatalytic coating braided into a highly flexible ribbon. The wire may be copper cored. The valve metal is preferably titanium, although tantalum or niobium are also preferred. The coating is preferably a mixed metal oxide coating. The braid is formed from wire sizes of from about 1/16 or less to about ⅛" in diameter and the braided ribbon may be about 0.1 to about 6" inches wide. Four system applications are disclosed, two for steel reinforced concrete, one for a tank bottom, and one for a buried pipe. The braided anode may be used in combination with valve metal ribbon or bar and may readily be electrically connected to power feeds or to itself by spot weld or crimp connections. Power feeds may be connected at a butt end or anywhere along the length of the braid.

91 Claims, 3 Drawing Sheets

CATHODIC PROTECTION ANODE AND SYSTEMS

This invention relates generally as indicated to a cathodic protection anode and systems using the anode, and more particularly, to a braided wire anode and system applications for the anode.

BACKGROUND OF THE INVENTION

Metal anodes of valve metals such as titanium, tantalum, or niobium, or alloys thereof having electrocatalytic coatings of platinum metals, platinum metal oxides, mixtures of valve metal oxides or other oxides with platinum metal oxides, and so-called mixed crystal material for use in electrolytic processes have been of much interest in recent years. By "valve metal" is meant a metal or alloy which, when connected as an anode in an electrolyte and under the conditions in which the metal or the alloy is subsequently to operate as an anode, exhibits the phenomenon that within a few seconds of the passage of the electrolysis current drops to less than 1% of the original value.

By "electrocatalytic coating" is meant a coating material applied to the metal base of the electrode, which will conduct an electrical current from the metal base to the electrolyte, and which will catalyze an electrochemical reaction at the surface of the electrode. Such a catalytic coating will prevent the passivation of a valve metal electrode base when it is used as an anode.

Valve metal anodes which include a noble metal or mixed metal oxide electrocatalytic coating are used in cathodic protection. Such materials, particularly with the coating, are expensive and somewhat difficult to fabricate. Such coated metals come in a variety of forms such as tubes, bars, ribbons, wires, or expanded mesh. Expanded mesh is now employed in steel reinforced concrete systems as well as other applications. The mesh is formed from expanded sheet and then coated and coiled into rolls for applications to a concrete deck. An example is seen in Bennett et al U.S. Pat. No. 4,900,410. The individual strands of such mesh are relatively small and subject to breakage. Because of the roll set the mesh won't readily lay flat. It has to be cut with tin snips and the rough and jagged edges present a fabricators nightmare.

Relatively small wire is much more readily fabricated, but may not have the capacity, strength or provide the redundancy desired for a system of long life and effectiveness. Larger wires can be used, but then are difficult to form or fabricate into an anode system. A wire anode system for tank bottoms may be seen in U.S. patent application Ser. No. 08/007,537, filed Jan. 22, 1993, now U.S. Pat. No. 5,340,455, entitled CATHODIC PROTECTION SYSTEM FOR ABOVE GROUND STORAGE TANK BOTTOMS AND METHOD OF INSTALLING.

It would therefore be desirable to have an anode having the characteristics of relatively small wire, but the capacity of larger wire, bar, or ribbon. It is also desirable that a low cost anode be highly flexible and easily coiled, yet not require a straightener. More importantly, it is important that the anode be available in continuous lengths, easily fabricated and electrically connected to itself and to power sources and not have the characteristics of coiled cut mesh strips.

SUMMARY OF THE INVENTION

A continuous length anode is formed of relatively small valve metal wire having a electrocatalytic coating braided into a highly flexible ribbon. The wire may be copper cored. The valve metal is preferably titanium, although tantalum or niobium are also preferred. The coating is preferably a mixed metal oxide coating. The braid is formed from wire sizes of from about 1/200 or less to about ⅛" in diameter and the braided ribbon may be about 0.1 to about 6" inches wide. Preferably braid is formed from wire 0.02 to 0.04" in diameter. Four system applications are disclosed, two for steel reinforced concrete, one for a tank bottom, and one for a buried pipe. The braided anode may be used in combination with valve metal ribbon or bar and may readily be electrically connected to power feeds or to itself by spot weld or crimp connections. Power feeds may be connected at a butt end or anywhere along the length of the braid.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
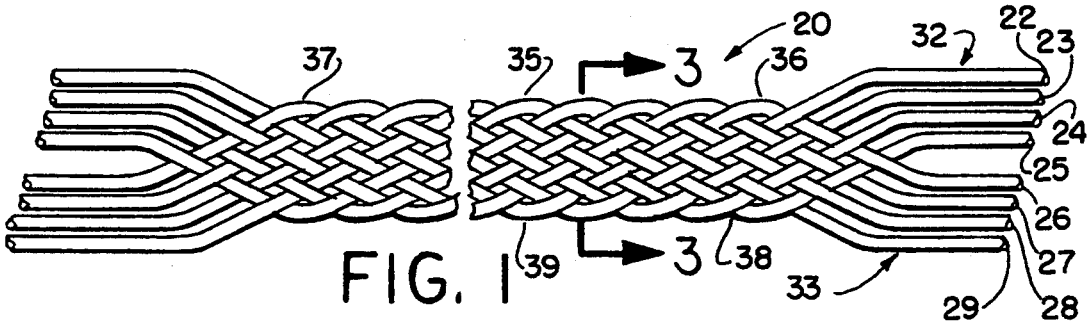
FIG. 1 is an illustration of one form of braided anode in accordance with the present invention.
Figure 3:
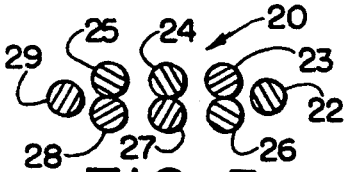
FIG. 3 is an enlarged transverse section seen from the line 3—3 of FIG. 1.

Referring initially to FIG. 1, there is illustrated a braided ribbon shown generally at 20 formed in such illustrated embodiment from eight wires indicated at 22, 23, 24, 25, 26, 27, 28 and 29. It will be appreciated that the wires at the ends of the ribbon are shown separated for clarity of illustration. Such wires are formed in two sets 32 and 33 of four which are woven in the criss-cross weave illustrated to form the braided ribbon. In such braiding, the wires of each set go over and under alternate wires of the opposite set. In the preferred form of FIG. 1, the angle of the cross weave with respect to the longitudinal axis of the ribbon is approximately 25° and each wire extends in the criss-cross or wave form pattern extending from one edge of the ribbon to the opposite edge. The wires are thus bent laterally at the nodes at the edges of the ribbon and are as well bent to go over and under each other as seen in FIG. 3. Assuming the break illustrated was not present in FIG. 1, the nodes for the wire 26 along the edge 35, are shown at 36 and 37. The opposite intermediate node for such wire along the edge 38 is shown at 39.

The braided ribbon is formed on a braiding machine and it will be appreciated that more or fewer wires may be employed. However, at least three wires are required to form a braid. In any event, the braiding of the component strands forms a regular diagonal pattern down the length and places or arranges the wires in a diagonally woven or criss-cross pattern as illustrated.

Figure 4:
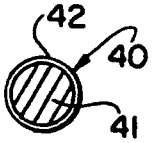
FIG. 4 is a further enlarged transverse section of one form of wire which may be used to form the braid.
Figure 5:
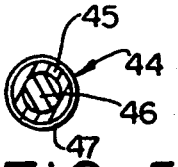
FIG. 5 is a similar section of another form of wire.

Referring now to FIGS. 4 and 5, and initially to FIG. 4, it will be seen that the wire shown generally at 40 is formed of a valve metal 41 having an electrocatalytic coating 42. As far as the valve metals are concerned, the preferred valve metals are titanium, niobium, or tantalum, and, of those, titanium, is preferred. Other valve metals may also be used. The coating may be that of a noble or precious metal or precious metal oxide, or a mixed metal oxide, as is well known in the art. The mixed metal oxide coating is preferred.

An alternative form of wire is indicated in FIG. 5 at 44. The wire includes a valve metal substrate 45, a copper core 46, and the electrocatalytic coating 47. The valve metal substrate and the electrocatalytic coating may be of the same preferred materials as used in the wire of FIG. 4. The wire of FIG. 5 has a higher current capacity which, in some applications, may be desirable.

Figure 2:
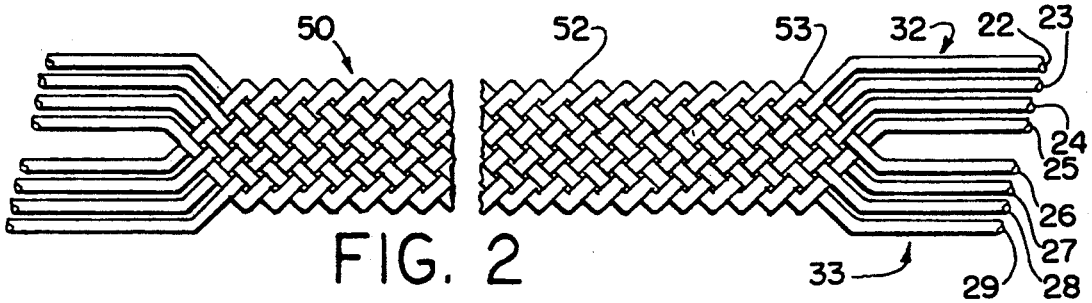
FIG. 2 is an illustration of another somewhat tighter form of braid.

Referring now to FIG. 2, there is illustrated an alternative form of braided ribbon indicated generally at 50 which may be formed of the same wires 22–29 arranged in two groups of four each shown at 32 and 33 which are cross woven with respect to each other to form a tighter, more dense, and slightly wider ribbon. The cross angle of the weave of the ribbon 50 is approximately 45° and the node-to-node dimension is approximately half that of the ribbon of FIG. 1. This may be seen in comparing the distance between the nodes 52 and 53 for the wire 26 in FIG. 2 versus the distance (36–37) in FIG. 1. The density of the ribbon of FIG. 2 is much greater and such ribbon has a void fraction of about 5% or less while the ribbon of FIG. 1 has a void fraction of about 20%. The void fraction is simply the percentage of voids in the area of the ribbon as seen in plan. The ribbon of FIG. 1 has significantly larger voids.

As indicated, relatively small flexible wires are preferred, although in some applications heavier, larger diameter wires may be employed. It is preferred that the wires be less than about $\frac{1}{8}$" in diameter. The width of the completed braided ribbon may vary from approximately 0.1" to about 6", which is dependent upon the number and size of wires used. The wire braid is manufactured in continuous lengths and coiled on spools for shipment to a shop or fabricating site for construction of an anode system or components of that system.

Figure 6:
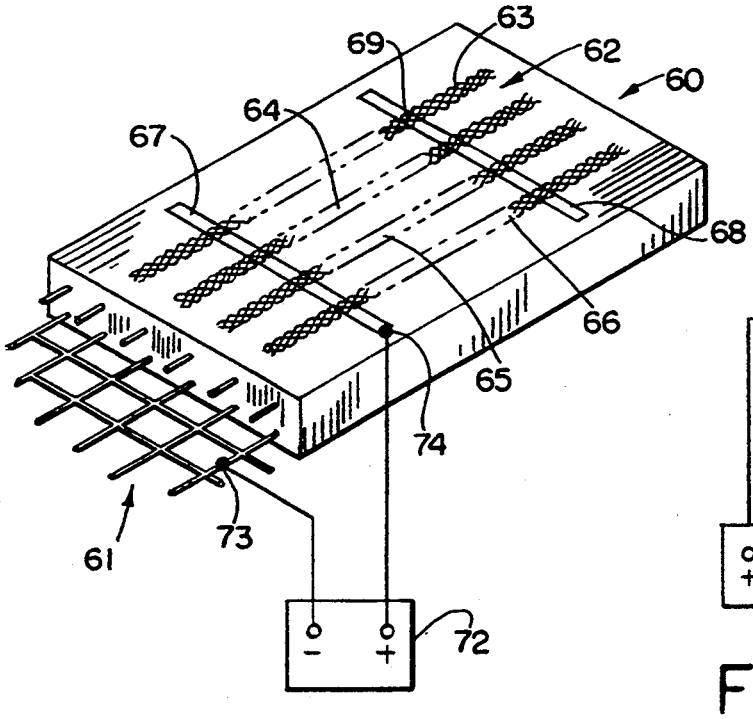
FIG. 6 is a fragmentary schematic of an anode using such braid to protect steel reinforcing in a concrete deck.

Referring now to FIG. 6, there is illustrated a cathodic protection system for use in protecting a steel reinforced concrete deck shown generally at 60. The reinforcing steel is shown generally at 61. The anode is shown generally at 62 which is fabricated on top of the deck and formed into a pattern. The anode may be formed by a parallel lengths of braiding indicated at 63, 64, 65, and 66 which extend parallel to each other and which are electrically connected to transverse valve metal ribbons or bars 67 and 68. The ribbons or bars may be of the same valve metal as indicated, and may be coated or uncoated. The electrical connection between the braid and the bar or ribbon indicated at 69, is formed by one or more tack or spot welds. The intimate association of the wires within the braid does not require that each individual wire strand of the braid be tack welded to the conductor bar or ribbon. A rectifier indicated at 72 is provided electrically connected at 73 to the steel of the reinforcing and at 74 to the bar or ribbon 67. A plurality or redundancy of such electrical connection may abe provided.

The braided ribbon is simply unspooled on the deck and cut to the desired lengths. As an example, the parallel lengths of braid may be on one foot centers and the transverse bars or ribbons may be about twenty five feet apart. The spacing along the conductor bar or ribbon may be on uniform centers although variations may be employed depending on the density of the reinforcing bar at certain locations of the deck, such as around supporting columns. When the braid is cut to length, the end cut may be crimped or taped, much like a rope to avoid unraveling. After the anode pattern is fabricated and electrically connected to the rectifier and the rectifier in turn to the reinforcing steel, an ion conductive overlay is placed over the anode. The overlay forms the wear or traffic surface for the deck and also more uniformly distributes the current through the concrete to the reinforcing steel. A typical application of the braided anode system as seen in FIG. 6 may be for a bridge deck or a garage deck. With the overlay in place, the rectifier is turned on to impress a current from the anode to the steel reinforcing bar.

Figure 7:
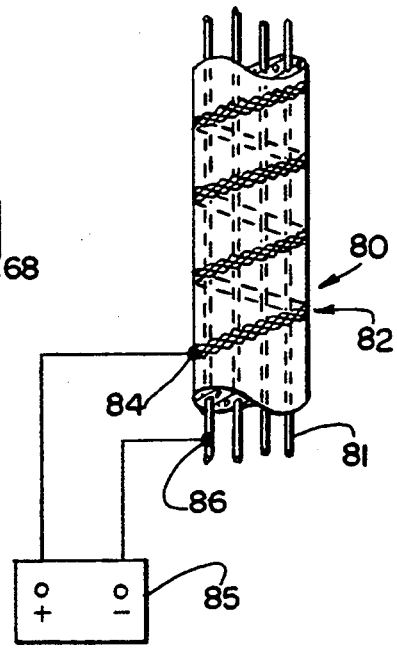
FIG. 7 is a fragmentary schematic of a braided anode applied to a steel reinforced concrete column.

In FIG. 7 there is illustrated a concrete column indicated generally at 80 which includes reinforcing steel 81. Typically, in a concrete column, the reinforcing steel is in the form of a cage. The column illustrated is circular in section although it will be appreciated that the anode of the present invention can readily be applied to other sectional shapes.

The anode, shown generally at 82, is a section of braid which is spirally wrapped around the exterior of the column. The spacing or lead of the spiral may be about one foot. The anode is electrically connected at 84 to the rectifier 85 which is in turn connected to the steel reinforcing at 86. The spirally wound braided ribbon anode may be secured to the vertical surface of the column in a variety of ways such as by bands or conductive adhesive. The anode should not be connected to the vertical surface of the concrete by metal fasteners which are conveniently explosively or power driven. If the metal fastener contacts the steel reinforcing, a short may occur which would render the system ineffective. After the anode is applied in place, it may be covered by an ion conductive overlay such as in connection with the bridge-deck. The overlay may applied in the same manner as shotcrete, for example. The overlay encases the anode and also assists in distributing the current flow through the concrete to the steel reinforcing. After the conductive overlay is applied, the rectifier is turned on to actuate the system.

Figure 8:
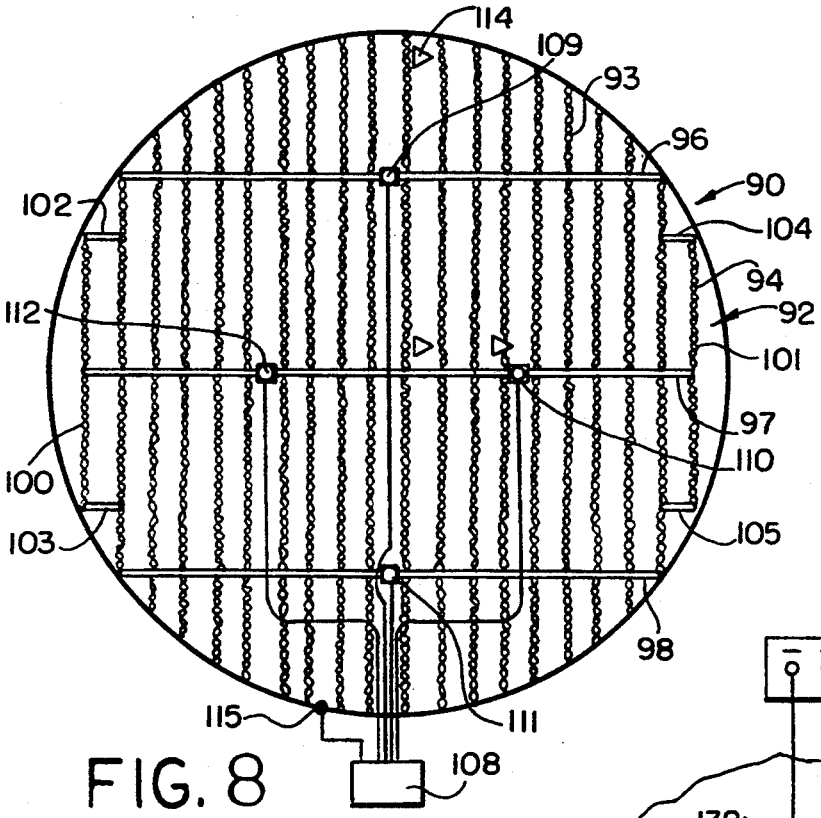
FIG. 8 is a schematic plan view of a fabricated anode for protecting a tank bottom.

Referring now to FIG. 8, there illustrated a circular tank bottom 90. A fabricated anode indicated generally at 92 extends in a compacted ionic conductor beneath the circular tank bottom. As disclosed in the above identified copending Kroon et al application, the compacted ionic conductor may be a relatively vertically narrow envelope of compacted sand on which the tank bottom is constructed. The anode is constructed on a layer of such sand which extends between a safety liner below and the tank bottom above. The anode is formed by a series of braid strips indicated at 93 and 94 which extend parallel to each other and which are electrically connected to transversely extending ribbons or bars also of a valve metal as seen at 96, 97 and 98. The ribbon or bar 97 is on a major diameter of the circular tank bottom while the ribbons or bars 96 and 98 are symmetrically disposed with respect to the diametral center conductor 97 and are on chords. The continuous braided anode segments are secured to the ribbons or bars electrically and on substantially uniform centers. The length of braid at the ends of the diametral ribbon or bar 97 seen at 100 and 101 which are too short to contact the bars or ribbons 96 and 98, may be connected at their ends to the adjacent braid through short sections of bar or ribbon seen at 102, 103, 104 and 105.

An external rectifier is provided at 108 and is connected to the fabricated anode by a redundancy of connections seen at 109, 110, 111, and 112. Reference cells may be provided as indicated by the triangular symbols seen at 114. There may be a redundancy of both power feed connections and reference cells. The rectifier 108 is also electrically connected to the tank bottom as indicated at 115.

As the tank is being constructed, the envelope above the safety liner is filled with compacted sand, for example, and leveled. The anode is then constructed. Additional sand is placed over the anode and compacted and then leveled to form a flat platform surface on which the tank bottom is constructed. The anode is tested periodically during the course of the construction. Great care must be taken that the anode not contact the bottom of the tank. It is also important that the ionic conductor within which the anode is encased not be too conductive or electronically conductive since a short might tend to occur and sensitive electronic leak detectors would be adversely affected. In any event, the braided ribbons may conveniently be unrolled and cut to the lengths indicated quickly to fabricate the anode illustrated.

Figure 9:
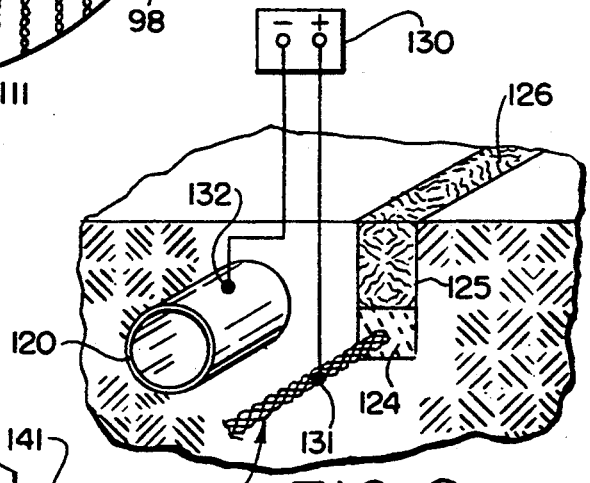
FIG. 9 is a fragmentary schematic of an anode in accordance with the present invention protecting a buried pipe.

Referring now to FIG. 9, there is illustrated a buried pipe shown generally at 120. The anode indicated generally at 122, is in the form of a continuous braid ribbon which extends parallel to the pipe. The anode is surrounded by a conductive carbonaceous backfill indicated at 124. The anode and the backfill may be positioned at the bottom of a relatively narrow trench indicated at 125 which has been backfilled as seen at 126. The depth of the trench may vary to position the parallel anode either directly opposite, over or under the cross country pipe. Also, anodes may be installed at both sides of the pipe and more than one anode may be installed in each trench. For example, an anode may be installed at the bottom of a trench, surrounded by the carbonaceous material, partially backfilled, and another anode installed thereabove. As in the FIG. 8 embodiment, the anode may be installed initially by placing approximately half the carbonaceous material in the bottom of the trench, then stringing the anode therealong, and then placing the rest of the carbonaceous backfill over the anode before backfilling the trench. As illustrated, the system includes a rectifier 130 which is electrically connected to the anode at 131 and to the pipe at 132. There will usually be a number of rectifiers, test stations and reference cells spaced along the right away of the pipe line. In any event, the anode can very easily be installed simply by unspooling it into its proper position in the properly prepared trench.

Figure 10:
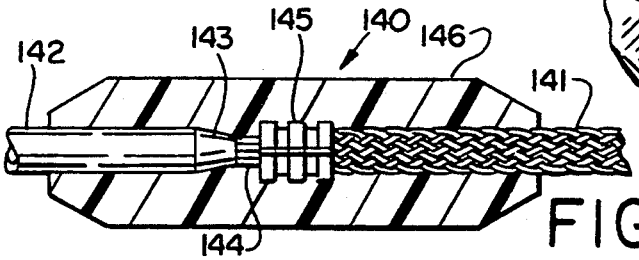
FIG. 10 is a enlarged illustration of a power feed-to-braid butt end connection.

A wide variety of electrical connections may be made with the braided anode of the present invention. As seen in FIG. 10, the connection shown generally at 140 is between one end of braided anode 141 and insulated power lead 142. The insulated power lead has its insulation removed as seen at 143 to expose the bare conductor cable 144. The bare cable then is overlapped a short distance with the end of the braided anode 141 and the two are enclosed in a compression fitting 145. The crimping of the sleeve 145 provides a good mechanical connection between the conductor and the end of the braided ribbon. The connection may be then tinned or silvered and then encased in a epoxy resin such as seen at 146. The epoxy resin may be provided by a splice kit which enables the resin components to be formed to the shape shown. It will be appreciated that the ends of two braids of the same or slightly different size may be connected in the same manner.

Figure 11:
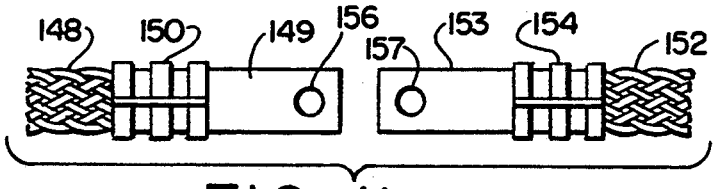
FIG. 11 is a further enlarged form of braid-to-braid connection.

In FIG. 11 there is illustrated a braided anode 148 connected to a copper lug 149 by compression fitting 150. Similarly, the braided anode 152 is connected to copper lug 153 by compression fitting 154. Both lugs are provided with holes seen at 156 and 157, respectively, so that the two lugs may readily be bolted together. The mechanical connection may then be tinned or silvered and encased in insulation with an epoxy splice kit.

Figure 12:
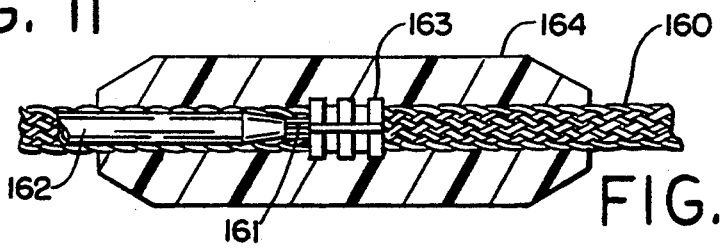
FIG. 12 is a view similar to FIG. 10 illustrating a power feed-to-braid lap splice connection.

FIG. 12 illustrates a connection similar to that of FIG. 10, but rather than a butt splice, a lap splice is illustrated. The braided anode 160 is continuous and the bare section 161 of power feed 162 is simply overlapped with a major flat side of the braided anode and the compression fitting 163 mechanically connects the bare conductor to the braided anode at the selected location. The entire connection may again be silvered or tinned and enclosed in the epoxy insulation shown at 164.

Figure 13:
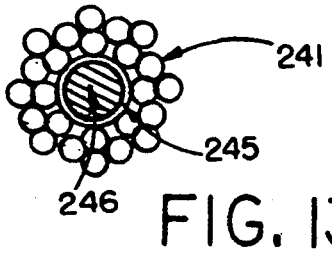
FIG. 13 is an enlarged transverse section of another form of braid in accordance with the present invention.
Figure 14:
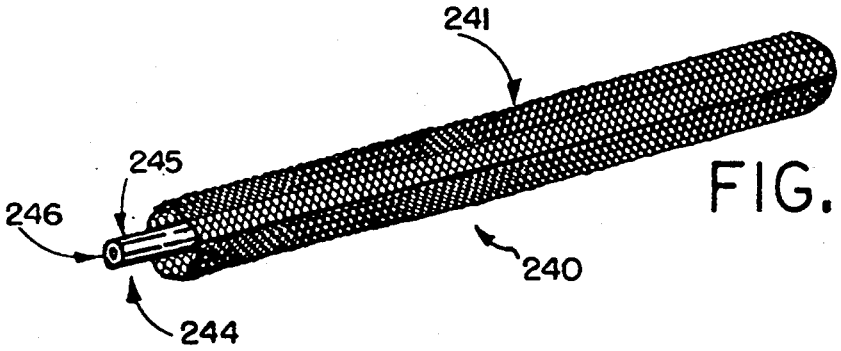
FIG. 14 is a fragmentary schematic perspective view of a rope braid as seen in FIG. 13.

Referring now to FIGS. 13 and 14, there is illustrated a schematic representation of an alternative form of braided anode in the form of a braided rope, indicated generally at 240. The braided anode 240 which is shown in cross-section in FIG. 13, includes a central conducting wire 244, around which and in electrical contact therewith, is the braided wire generally shown at 241. The braided wire strands may be, for example, 0.02" in diameter. The conducting wire 244, which may be, for example, 0.06" in diameter, includes a copper core 246, and a valve metal outer portion 245. The use of the copper-cored conducting wire 244 incorporated in the braid allows for much greater spacing between separate transverse valve metal ribbons or bars as shown in FIG. 6 at 67 and 68.

Figure 15:
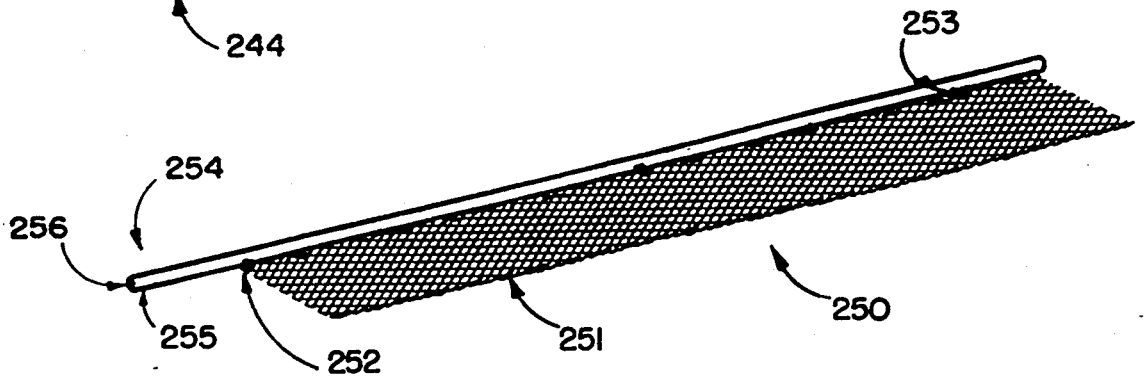
FIG. 15 is a similar view of another alternative form of braided anode having a conductor electrically attached along one edge.

Referring now to FIG. 15, there is illustrated a further alternative form of a braided anode incorporating a braided portion and a conducting wire portion. The braided anode shown generally at 250 includes a braided ribbon portion 251 and a conducting wire 254. The conducting wire 254 is electrically connected, such as by spot welding or mechanically crimping or fastening, at spaced positions such as shown at 252 and 253, to the braided ribbon portion 251. The conducting wire 254 includes a copper core 256 and a valve metal outer portion 255.

Figure 16:
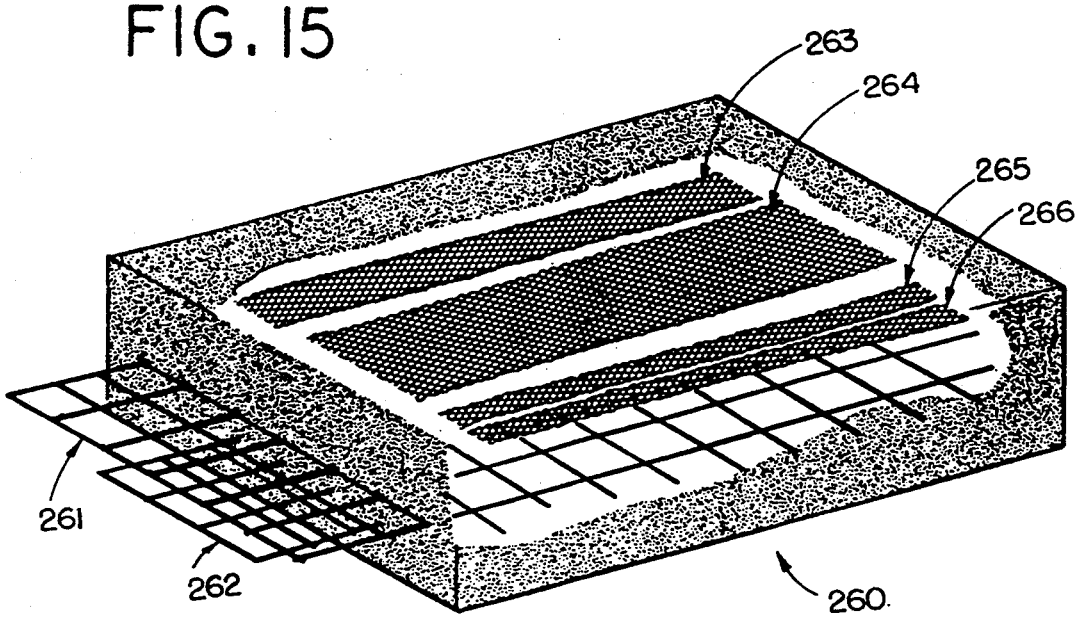
FIG. 16 is a view similar to FIG. 6 illustrating how the size, type and/or spacing of the braid may be tailored to the surface area of the steel requiring protection.

In FIG. 16 illustrated a portion of a cathodic protection system for use in protecting a steel reinforced concrete deck shown generally at 260. The rectifier and transverse conductor ribbons are omitted for clarity. A number of different braided ribbons are shown, to indicate that the type or number of braided ribbon may be adjusted to take into account the needs of the system to be protected. One layer of a steel reinforcing grid is indicated at 261. A second layer of a steel reinforcing grid, within only a portion of the concrete deck 260 is shown at 262.

The braided anodes are shown in parallel lengths indicated at 263, 264, 265, and 266. The wider braided anode 264 presents more surface area through which the anodic current can be passed, and a larger total valve metal cross-section to allow greater current carrying capacity for the anode. Such a braided anode would be used in the case as shown, where more steel surface area, such as provided by the two steel grids 261 and 262, would need to be cathodically protected.

Alternatively, the two braided anodes at 265 and 266 may be used side-by-side to provide increased anodic current capacity in an area where more anodic current is needed. The increased current capacity of the braided anodes 265 and 266 may also be accomplished by using a braided anode with a greater number of strands in the braid, or by larger strands in the braid, as compared to other braided anodes for the particular structure.

It can now be seen that there is provided a braided wire anode and systems using such anode having high capacity, high strength, and providing a redundancy for long life and effectiveness. The anode is also easily manufactured, of lower cost, and more easily fabricated into the desired patterns for effective cathodic protection of a variety of metal objects.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

We claim:

1. An anode for the cathodic protection of metal structure comprising a diagonally cross-woven braid of metal wires each having an electrocatalytic coating adapted to be spaced from the structure to be protected whereby a current may be impressed between the anode and the structure.

2. An anode as set forth in claim 1 wherein said anode comprises a braided ribbon formed from at least three wires.

3. An anode as set forth in claim 2 wherein the metal of said wires is selected from a group consisting of titanium, niobium and tantalum.

4. An anode as set forth in claim 3 wherein said wires each includes a copper core.

5. An anode as set forth in claim 4 wherein said electrocatalytic coating is a mixed metal oxide.

6. An anode as set forth in claim 5 wherein said wires are each from about 1/200 to about ⅛" in diameter.

7. An anode as set forth in claim 6 wherein said braided ribbon is from about 0.1 to about 6" wide.

8. An anode as set forth in claim 7 wherein said anode is cross woven tightly to minimize voids between the wires of the braid.

9. An anode as set forth in claim 8 wherein said anode is provided in spools for unspooling for field fabrication.

10. A anode as set forth in claim 2 including a conductor running along said ribbon electrically connected thereto.

11. An anode as set forth in claim 1 wherein said anode comprises a braided rope formed from at least three wires.

12. An anode as set forth in claim 11 including a conductor in the center of the rope.

13. An anode as set forth in claim 12 wherein said conductor comprises a valve metal clad copper wire.

14. A cathodic protection system for tank bottoms comprising an anode spaced from the tank bottom, whereby a current may be impressed between the anode and the tank bottom, the anode comprising a fabricated pattern including a diagonally cross-woven braid of metal wires.

15. A system as set forth in claim 14 wherein said braid is electrically connected to transverse ribbons to form a substantially uniform density fabricated pattern beneath the tank bottom.

16. A system as set forth in claim 15 including a rectifier electrically connected to said tank bottom and said pattern to impress the current between the anode and tank bottom.

17. A system as set forth in claim 16 including a plurality of power feed connections between the rectifier and fabricated pattern.

18. A system as set forth in claim 17 including a plurality of reference cells arranged about the pattern.

19. A system as set forth in claim 14 wherein said anode comprises a ribbon formed from at least three wires.

20. A system as set forth in claim 19 wherein said ribbon is formed of wires each having an electrocatalytic coating.

21. A system as set forth in claim 20 wherein the metal of said wires is selected from a group consisting of titanium, niobium, and tantalum.

22. A system as set forth in claim 21 wherein said wires each includes a copper core.

23. A system as set forth in claim 22 wherein said electrocatalytic coating is a mixed metal oxide.

24. A system as set forth in claim 23 wherein said wires are each from about 1/200 to about ⅛" in diameter.

25. A system as set forth in claim 24 wherein said braided ribbon is from about 0.1 to about 6" wide.

26. A system as set forth in claim 25, wherein said anode is cross woven tightly to minimize voids between the wires of the braid.

27. A system as set forth in claim 19 including a conductor running along said ribbon electrically connected thereto.

28. A system as set forth in claim 14 wherein said anode comprises a braided rope formed from at least three wires.

29. A system as set forth in claim 28 including a conductor in the center of the rope.

30. A system as set forth in claim 29 wherein said conductor comprises a valve metal clad copper wire.

31. A cathodic protection system for a steel reinforced concrete structure comprising an anode spaced from the steel, whereby a current may be impressed between the anode and the steel, the anode comprising a diagonally cross-woven braid of metal wires.

32. A system as set forth in claim 31 wherein said structure is a deck and said braid of metal wires is formed into a pattern corresponding to the steel and which is electrically connected to a rectifier also connected to such steel.

33. A system as set forth in claim 32 wherein said pattern includes at least one metal bar electrically connected to the braid.

34. A system as set forth in claim 33 wherein said rectifier is electrically connected to said bar.

35. A system as set forth in claim 31 wherein said structure is a concrete column, and said braid of metal wires is wrapped around said column.

36. A system as set forth in claim 35 wherein said braid of metal wires is spirally wrapped around said column.

37. A system as set forth in claim 31 wherein said anode comprises a ribbon formed from at least three wires.

38. A system as set forth in claim 37 wherein said ribbon is formed of wires each having a electrocatalytic coating.

39. A system as set, forth in claim 38 wherein the metal of said wires is selected from a group consisting of titanium, niobium, and tantalum.

40. A system as set forth in claim 39 wherein said wires each includes a copper core.

41. A system as set forth in claim 40 wherein said electrocatalytic coating is a mixed metal oxide.

42. A system as set forth in claim 41 wherein said wires are each from about 1/200 to about ⅛" in diameter.

43. A system as set forth in claim 42 wherein said braided ribbon is from about 0.1 to about 6" wide.

44. A system as set forth in claim 43 wherein said anode is cross woven tightly to minimize voids between the wires of the braid.

45. A system as set forth in claim 37 including a conductor running along said ribbon electrically connected thereto.

46. A system as set forth in claim 31 wherein said anode comprises a braided rope formed from at least three wires.

47. A system as set forth in claim 46 including a conductor in the center of the rope.

48. A system as set forth in claim 47 wherein said conductor comprises a valve metal clad copper wire.

49. A cathodic protection system for buried pipes comprising an anode spaced from the pipe, whereby a current may be impressed between the anode and the pipe, the anode comprising a diagonally cross-woven braid of metal wires.

50. A system as set forth in claim 49 wherein said braided anode is buried and extends generally parallel to the pipe.

51. A system as set forth in claim 50 wherein said braided anode is surrounded by a conductive carbonaceous backfill.

52. A system as set forth in claim 49 wherein said anode comprises a braided ribbon formed from at least three wires.

53. A system as set forth in claim 52 wherein said ribbon is formed of wires each having an electrocatalytic coating.

54. A system as set forth in claim 53 wherein the metal of said wires is selected from a group consisting of titanium, niobium, and tantalum.

55. A system as set forth in claim 54 wherein said wires each includes a copper core.

56. A system as set forth in claim 55 wherein said electrocatalytic coating is mixed metal oxide.

57. A system as set forth in claim 56 wherein said wires are each from about 1/200 to about ⅛" in diameter.

58. A system as set forth in claim 57 wherein said braided ribbon is from about 0.1 to about 6" wide.

59. A system as set forth in claim 58, wherein said anode is cross woven tightly to minimize voids between the wires of the braid.

60. A system as set forth in claim 52 including a conductor running along said ribbon electrically connected thereto.

61. A system as set forth in claim 49 wherein said anode comprises a braided rope formed from at least three wires.

62. A system as set forth in claim 61 including a conductor in the center of the rope.

63. A system as set forth in claim 62 wherein said conductor comprises a valve metal clad copper wire.

64. A cathodic protection system for metal structures comprising a diagonally cross-woven braid of metal strands adapted to be spaced from the structure to be protected in an electrolyte to form an anode, and means to impress a current between the anode and the structure.

65. A system as set forth in claim 64 wherein said anode comprises a braided ribbon formed from at least three strands.

66. A system as set forth in claim 65 wherein said ribbon is formed of strands each having an electrocatalytic coating.

67. A system as set forth in claim 66 wherein the metal of said strands is selected from a group consisting of titanium, niobium and tantalum.

68. A system as set forth in claim 67 wherein said strands are wires and each includes a copper core.

69. A system as set forth in claim 68 wherein said wires each are from about 1/200 to about ⅛" in diameter.

70. A system as set forth in claim 69 wherein said braided ribbon is from about 0.1 to about 6" wide.

71. A system as set forth in claim 70 wherein said anode is cross woven tightly to minimize voids between the wires of the braid.

72. A system as set forth in claim 71 wherein said anode is provided in spools for unspooling for field fabrication.

73. A system as set forth in claim 66 wherein said electrocatalytic coating is a mixed metal oxide.

74. A system as set forth in claim 65 including a conductor running along said ribbon electrically connected thereto.

75. A system as set forth in claim 64 wherein said anode comprises a braided rope formed from at least three strands.

76. A system as set forth in claim 75 including a conductor in the center of the rope.

77. A system as set forth in claim 76 wherein said conductor comprises a valve metal clad copper wire.

78. A method for the cathodic protection of metal structures comprising the steps of using a diagonally cross-woven braid of metal strands as an anode adapted to be spaced from the structure to be protected in an electrolyte, and impressing a current between the anode and the structure.

79. A method as set forth in claim 78 wherein said anode comprises a braided ribbon formed from at least three strands.

80. A method as set forth in claim 79 wherein, said ribbon is formed of strands each having an electrocatalytic coating.

81. A method as set forth in claim 80 wherein the metal of said strands is selected from a group consisting of titanium, niobium and tantalum.

82. A method as set forth in claim 81 wherein said strands are wires and each includes a copper core.

83. A method as set forth in claim 82 wherein said wires each are from about 1/200 to about $\frac{1}{8}''$ in diameter.

84. A method as set forth in claim 83 wherein said braided ribbon is from about 0.1 to about 6″ wide.

85. A method as set forth in claim 84 wherein said anode is cross woven tightly to minimize voids between the wires of the braid.

86. A method as set forth in claim 85 wherein said anode is provided in spools for unspooling for field fabrication.

87. A method as set forth in claim 80 wherein said electrocatalytic coating is a mixed metal oxide.

88. A method as set forth in claim 79 including a conductor running along said ribbon electrically connected thereto.

89. A method as set forth in claim 78 wherein said anode comprises a braided rope formed from at least three strands.

90. A method as set forth in claim 89 including a conductor in the center of the rope.

91. A method as set forth in claim 90 wherein said conductor comprises a valve metal clad copper wire.

* * * * *